United States Patent [19]

Mendoza et al.

[11] 4,136,521

[45] Jan. 30, 1979

[54] MULTI-PURPOSE PORTABLE HYDRAULIC UNIT

[75] Inventors: Gregory E. Mendoza; Donald R. Henthorn; James F. Taylor, all of Simi Valley, Calif.

[73] Assignee: QMA Inc., Simi Valley, Calif.

[21] Appl. No.: 851,042

[22] Filed: Nov. 14, 1977

[51] Int. Cl.[2] ..... F15B 15/18

[52] U.S. Cl. ..... 60/477; 60/481; 60/DIG. 10; 254/133 R

[58] Field of Search ..... 60/477, 481, 482, DIG. 10; 254/50.3, 93 R, 133 R, DIG. 4

[56] References Cited

U.S. PATENT DOCUMENTS 2,200,133 5/1940 Mandl ..... 60/477 X

FOREIGN PATENT DOCUMENTS 731055 6/1955 United Kingdom ..... 60/481

*Primary Examiner*—Edgar W. Geoghegan
*Attorney, Agent, or Firm*—Ralph B. Pastoriza

[57] ABSTRACT

The unit comprises outer and inner coaxial cylinders defining an hydraulic fluid reservoir between the inner walls of the outer cylinder and the outer walls of the inner cylinder. The opposite ends of the cylinders are closed off by a lower closure means and an upper cylinder head. A single piston within the inner cylinder has first and second piston rods extending from opposite sides through the cylinder head and lower closure. The cylinder head includes an hydraulic pump with passages placing the reservoir into communication with the interior of the inner cylinder above the piston together with appropriate check valves so that operation of the hydraulic pump will move the piston down the inner cylinder to exert a pulling force on the first piston rod and a pushing force on the second piston rod.

5 Claims, 9 Drawing Figures

MULTI-PURPOSE PORTABLE HYDRAULIC UNIT

This invention relates generally to hydraulic tools and more particularly to a multi-purpose portable hydraulic unit.

BACKGROUND OF THE INVENTION

Hydraulic power units are well known in the art and usually are designed for specific operations. For example, it is known to compress large compression springs by hydraulic force. Further, hydraulic units have been employed for jacking up cars. Generally in any type of press where large forces must be exerted, hydraulic units are employed.

In a well-equipped auto shop or similar tool shop, there are of necessity several different hydraulic units for performing various tasks. Most such units are stationary and specifically designed for a given application. It would be highly advantageous, particularly in smaller shops and the like if some type of multi-purpose portable hydraulic unit could be provided capable of performing several of the various routine operations that must be carried out in the shop. A great advantage with such a unit would ensue, not only in savings of cost but also in savings of space.

BRIEF DESCRIPTION OF THE PRESENT INVENTION

Bearing the foregoing in mind, the present invention contemplates a multi-purpose portable hydraulic unit capable of carrying out many of the operations in a shop which heretofore required separate hydraulic units.

More particularly, in accord with this invention there is provided an outer cylinder and inner cylinder coaxial with the outer cylinder to define between the inside wall of the outer cylinder and the outside wall of the inner cylinder an annular reservoir for holding hydraulic fluid. A single piston head is provided in the interior of the inner cylinder. Closure means close off the lower ends of the outer and inner cylinders and a cylinder head incorporating hydraulic pump means is disposed on the upper end of the outer and inner cylinders. Appropriate first and second passages pass respectively to the annular reservoir and upper interior of the inner cylinder above the piston, these passages incorporating one-way check valves and communicating with the hydraulic pump means in the cylinder head.

First and second piston rods extend from the opposite ends of the piston head through the cylinder head and lower closure means so that either the first or second piston rod can be utilized to perform a particular operation depending upon whether a pulling force is required or a pushing force is required.

Various accessories are provided for use with the basic unit to enable the carrying out of a number of different operations by means of this single portable hydraulic unit.

BRIEF DESCRIPTION OF THE DRAWINGS

A better understanding of this invention will be had by referring to the accompanying drawings in which.

DETAILED DESCRIPTION OF THE INVENTION

Figure 1:
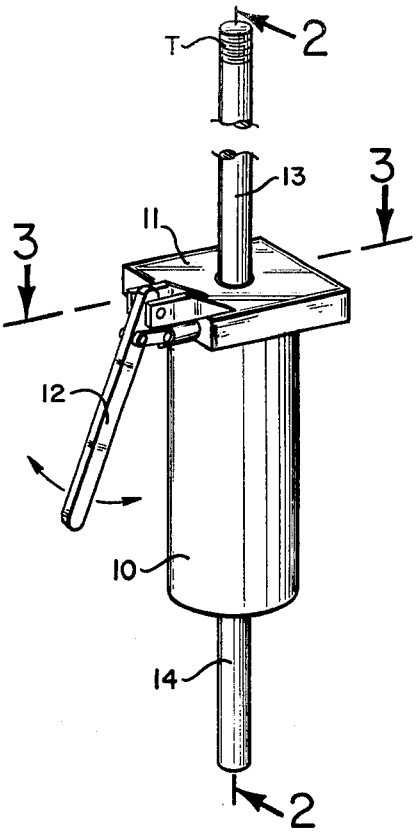
FIG. 1 is a perspective view of the basic multi-purpose portable hydraulic unit of this invention.

Referring first to FIG. 1 the exterior components of the hydraulic unit include an outer cylinder 10, cylinder head 11 and hydraulic pump actuating handle 12. A first piston rod 13 extends upwardly through the cylinder head 11 as shown and in accord with an important feature of this invention, there is provided a second piston rod 14 extending from the lower end of the cylinder.

Essentially, actuation of the handle 12 for the hydraulic pump in the cylinder head 11 will exert a pulling force on the piston rod 13 drawing it into the cylinder and a pushing force on the second piston rod 14 extending it further from the cylinder.

Figure 2:
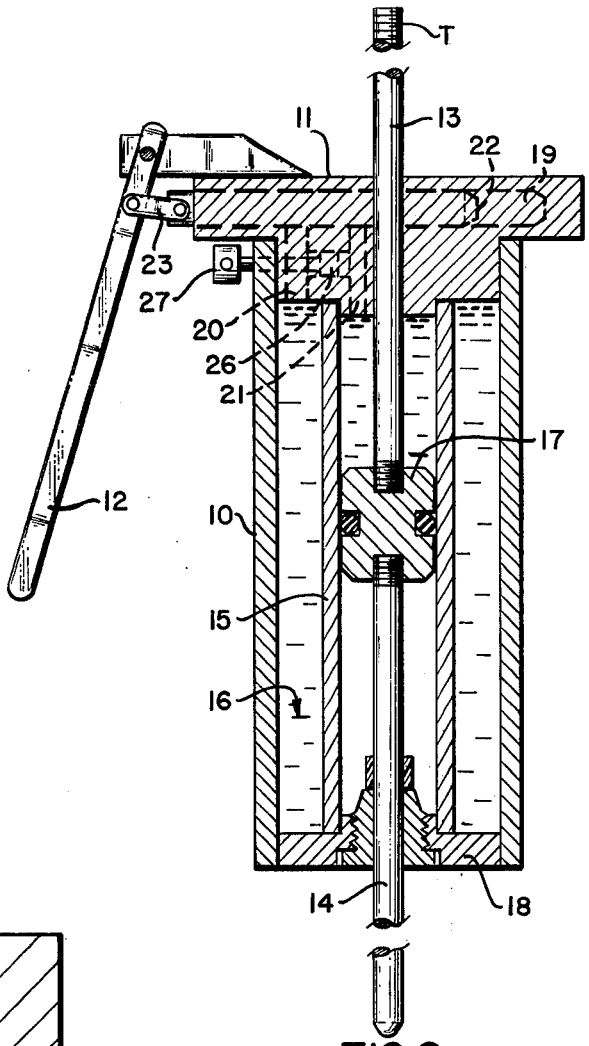
FIG. 2 is an enlarged view partly in cross-section looking in the direction of the arrows 2—2 of FIG. 1.

Referring now to FIG. 2, further details of the unit are shown.

Coaxially positioned within the outer cylinder 10 is an inner cylinder 15, the inside wall of the outer cylinder and the outside wall of the inner cylinder defining an annular reservoir 16 for holding hydraulic fluid. A piston head 17 is provided in the inner cylinder from the opposite sides of which the first and second piston rods 13 and 14 extend. The lower ends of the outer and inner cylinders 10 and 15 are closed off by a closure means 18 as shown.

Referring to the upper cylinder head 11, there is incorporated therein a hydraulic pump means including a pump bore 19 communicating with first and second passages 20 and 21 passing respectively to the annular reservoir 16 and the upper interior of the inner cylinder above the piston 17. These passages are indicated by the dotted lines in FIG. 2.

As also indicated by the dotted lines, there is provided a plunger 22 in the hydraulic pump bore 19 connected by link 23 to the actuating handle 12.

Figure 3:
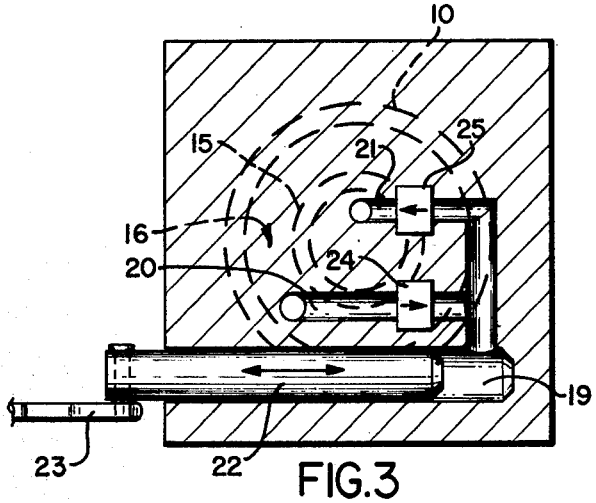
FIG. 3 is another cross-section taken in the direction of the arrows 3—3 of FIG. 1.

Referring to FIG. 3, the first and second passages 20 and 21 are clearly shown in communication with the pump bore 19 receiving the plunger 22. First and second check valves 24 and 25 are disposed in the passages 20 and 21 respectively for passing fluid from the annular reservoir 16 to the upper interior portion of the inner cylinder 15 but blocking flow in a reverse direction.

It will be evident from FIG. 3 that when the plunger 22 is withdrawn to the left, hydraulic fluid will be drawn in through the passage 20 and check valve 24 to the bore 19. When the plunger 22 moves in a reverse direction to the right, this hydraulic fluid will then be urged through the check valve 25 and passage 21 to the upper interior portion of the inner cylinder thereby forcing piston 17 as shown in FIG. 2 downwardly.

As shown in FIG. 2, there is also provided a by-pass valve 26 between the passages 20 and 21. This valve 26 is normally closed but is manually releasable to open position by knob 27. By opening the valve 26 after the piston has been hydraulically moved to its lower most position, the piston can simply be moved manually upwardly to reset the same, the fluid above the piston passing directly back to the reservoir through valve 26.

It should be understood that there is no fluid beneath the piston head 17, fluid only passing from the reservoir to the interior of the inner cylinder above the piston head. The hydraulic system is thus completely closed.

After the piston has been reset to its upper most position, the valve 26 is manually closed by knob 27 so that the unit is again ready for operation.

From the foregoing description, it will be evident that the hydraulic unit described is capable of exerting a pulling force on the first piston rod 13 and a pushing force on the second piston rod 14. This feature of being able to provide both types of forces permits the unit to be used in applications requiring either a pulling or a pushing force.

Figure 4:
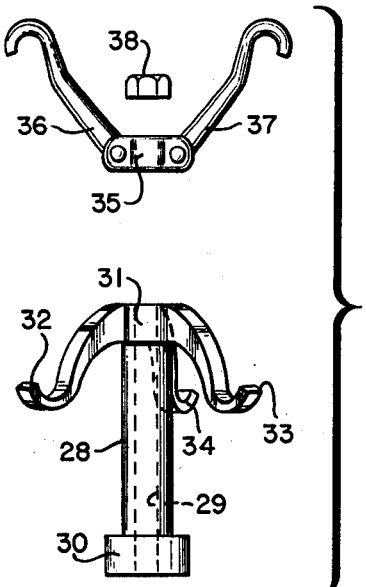
FIG. 4 is an exploded view of certain accessories which may be used in combination with the unit of FIG. 1.

Referring now to FIG. 4, there are shown some auxiliary elements for use with the unit of FIG. 1 for carrying out a spring compressing operation. Towards this end, these elements include a sleeve 28 receivable over the first piston rod 13, there being provided a bore 29 passing completely through the sleeve 28 for this purpose. The lower end of the sleeve terminates in a seat 30 for seating on the top of the cylinder head 11. The upper end of the sleeve in turn includes a collar 31 having three radially outwardly and downwardly extending hook elements 32, 33 and 34, preferably circumferentially spaced at 120°.

Cooperating with the elements described in FIG. 4 is an upper support member 35 for upper hooks 36 and 37 articulated to this support as indicated. A nut 38 is provided for locking the member 35 to the upper end of the piston rod 13.

Figure 5:
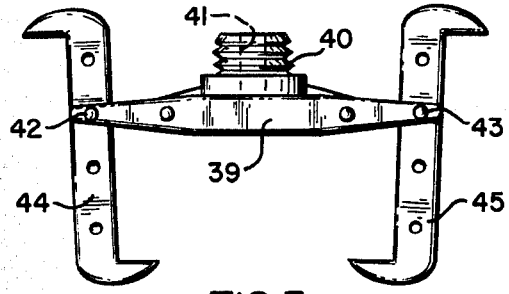
FIG. 5 shows a further accessory for use with the device of FIG. 1.

FIG. 5 illustrates another auxiliary component for use with the unit of FIG. 1 wherein there is provided a frame structure including a cross piece 39 and threaded central portion 40 arranged to be received in the closure means 18 of the unit shown in FIG. 2. The threaded element 40 includes a central bore 41 through which the second piston rod 14 passes. Articulated at opposite ends of the cross bar 39 as at 42 and 43 are a pair of hook members 44 and 45 serving as a holding means as will be subsequently described.

Figure 6:
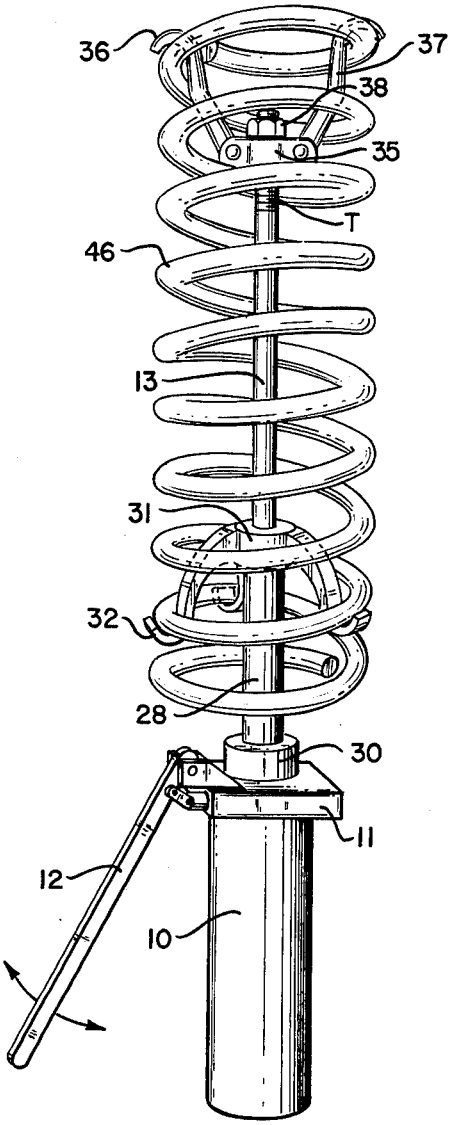
FIG. 6 is a perspective view of the invention showing an application to the compression of a spring.

Referring now to FIG. 6, the manner in which the elements described in FIG. 4 are utilized with the unit of FIG. 1 will become clear. In FIG. 6, the hydraulic unit is used to compress a compression spring shown at 46. Towards this end, the sleeve 28 is disposed over the first piston rod 13 as shown with the lower base or collar 30 seating on the cylinder head 11. The three hooks from the upper portion of the sleeve constitute a lower spring coil engaging means as shown for the hook 32.

The upper element 35 to which the hooks 36 and 37 are pivoted constitutes an upper spring coil engaging means the nut 38 locking the element 35 onto the upper end of the piston rod 13. In this respect, the upper end of the piston rod 13 includes threads T as shown.

If now the hydraulic unit is operated by the handle 12, the hydraulic fluid will force the piston within the cylinder downwardly, thereby pulling the first piston rod 13 downwardly and thus compressing the spring 46.

Figure 7:
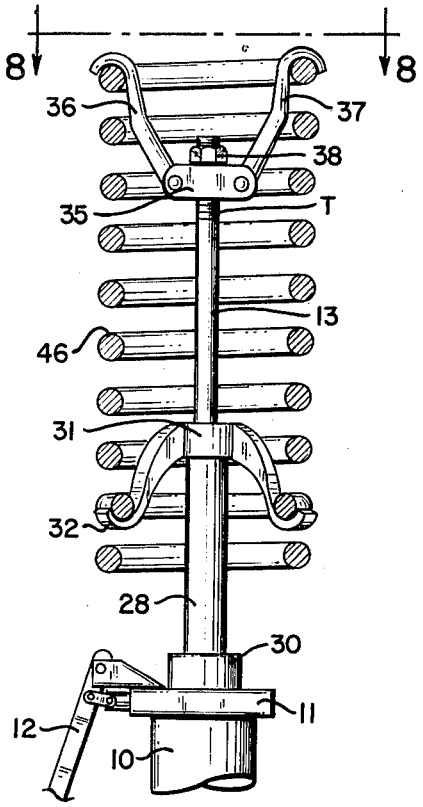
FIG. 7 is a fragmentary elevational view of the unit of FIG. 6 showing the spring after it has been compressed.

FIG. 7 shows the position of the various elements when the spring is compressed.

Figure 8:
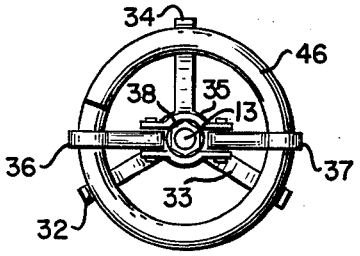
FIG. 8 is a top plan looking in the direction of the arrows 8—8 of FIG. 7.

In the cross section of FIG. 8, the circumferential spacing of the three hooks of the lower spring coil engaging means will be evident. Thus, the hooks 32, 33 and 34 engage under coil portions of one of the lower coils of the spring.

Figure 9:
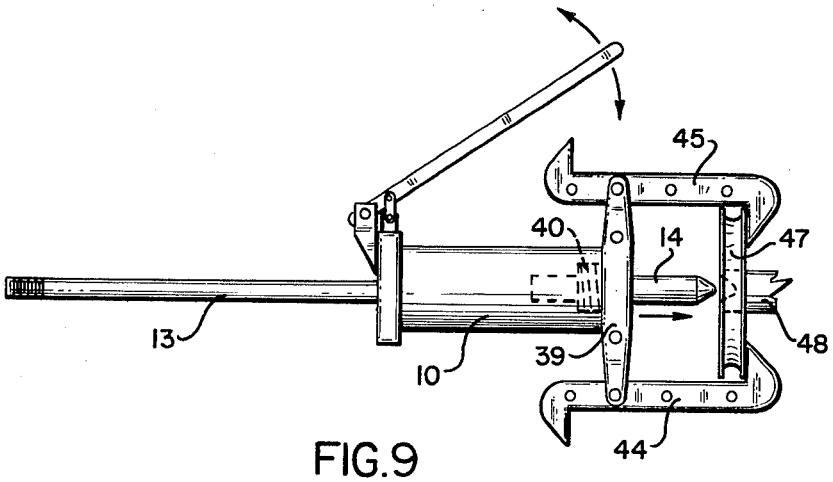
FIG. 9 shows another application of the unit utilizing the accessory of FIG. 5.

FIG. 9 shows an application of the hydraulic unit of this invention utilizing the accessories shown and described in FIG. 5. In this case, the second piston rod 14 is used as a pushing member for the removal of gears or pulleys from their shafts. Thus, in the particular example illustrated, the articulated hooks 44 and 45 are engaged at their far ends about peripheral portions of a pulley 47 on a shaft 48. The second piston rod 14 has its end engaging the end of the shaft 48 so that when the hydraulic unit 10 is actuated, the second piston rod 14 will push the shaft from the journalling portion of the pulley or, in effect, pull the pulley from its shaft.

It will be evident that the same type of frame structure and holding means could be utilized to pull gears from their shafts. Also, the frame structure could be used to hold a member at its end and a compression force exerted by the second piston rod 14 against an object to be squeezed or urged into position, such as a ball joint.

From the foregoing, it will thus be evident that the present invention provides in a single hydraulic unit a versatile device which can be utilized to carry out several different operations in a shop heretofore requiring individual or separate hydraulic means.

The unit itself is self-contained in that it holds its own hydraulic fluid in a closed system. Furthermore, it can be made relatively small and yet exert large forces as may be necessary in compressing certain types of springs and the like.

We claim:

1. A multi-purpose portable hydraulic unit including, in combination:

(a) an outer cylinder;

(b) an inner cylinder coaxial with said outer cylinder to define between the inside wall of said outer cylinder and the outside wall of said inner cylinder an annular reservoir for holding hydraulic fluid;

(c) a piston in the interior of said inner cylinder;

(d) closure means closing off the lower ends of said outer and inner cylinders;

(e) a cylinder head on the upper end of said outer and inner cylinders incorporating hydraulic pump means communicating with first and second passages passing respectively to said annular reservoir and upper interior of said inner cylinder above said piston;

(f) a first piston rod extending from said piston out through said cylinder head;

(g) a second piston rod extending from the opposite end of said piston out through said closure means;

(h) first and second pressure responsive one-way check valves in said first and second passages respectively; and (i) a bypass valve between said first and second passages permitting passage of fluid from above said piston back to said reservoir after said piston has been driven downwardly by operation of said hydraulic pump means, said valve being manually operable so that said piston can be moved upwardly to a reset position, whereby operation of said hydraulic pump means when said reservoir and portion of said inner cylinder above said piston are filled with hydraulic fluid exerts a pulling force on said first piston rod and a pushing force on said second piston rod so that said unit may be used in applications requiring either a pulling or pushing force.

2. The subject matter of claim 1, including, in combination, a sleeve receivable over said first piston rod to seat on said cylinder head at its lower end, said first piston rod extending beyond the upper end of said sleeve; lower spring coil engaging means secured to the upper end of said sleeve; and upper spring coil engaging means coupled to the upper end of said first piston rod whereby coils of a compression spring positioned between said lower and upper spring engaging means can be compressed by operation of said hydraulic pump means.

3. The subject matter of claim 1, including frame means secured to the lower end of said outer cylinder and extending therefrom to terminate in holding means for holding an object in axial alignment with said second piston rod whereby a compression force may be exerted on said object by operating said hydraulic pump means.

4. The subject matter of claim 2, in which said lower spring engaging means comprises a collar having three radially and downwardly extending hook elements circumferentially spaced at 120° to hook about circumferentially spaced lower coil portions, said collar seating on the upper ends of said sleeve at the point said first piston rod emerges.

5. The subject matter of claim 3 in which said frame means includes a cross member secured to the lower end of said outer cylinder; and a pair of hook elements articulated to opposite ends of said cross member for engaging peripheral portions of a pulley, said object engaged by said second piston rod constituting the end of the shaft for said pulley whereby said pulley can be pulled from said shaft by operation of said hydraulic pump means.

* * * * *